US007806608B2

(12) United States Patent
Saito et al.

(10) Patent No.: US 7,806,608 B2
(45) Date of Patent: Oct. 5, 2010

(54) TAPE/TUBE PRINTER

(75) Inventors: Masao Saito, Tokyo (JP); Hiroaki Sudo, Tokyo (JP); Yasunori Kudo, Tokyo (JP)

(73) Assignee: Max Co., Ltd., Tokyo (JP)

( * ) Notice: Subject to any disclaimer, the term of this patent is extended or adjusted under 35 U.S.C. 154(b) by 897 days.

(21) Appl. No.: 11/632,730

(22) PCT Filed: Jul. 12, 2005

(86) PCT No.: PCT/JP2005/012857

§ 371 (c)(1),
(2), (4) Date: Jan. 18, 2007

(87) PCT Pub. No.: WO2006/009016

PCT Pub. Date: Jan. 26, 2006

(65) Prior Publication Data

US 2007/0253759 A1 Nov. 1, 2007

(30) Foreign Application Priority Data

Jul. 21, 2004 (JP) ..... 2004-213583

(51) Int. Cl.
*B41J 11/66* (2006.01)
*B41J 11/70* (2006.01)

(52) U.S. Cl. ..... 400/621

(58) Field of Classification Search ..... 400/621; *B41J 11/66, 11/70*
See application file for complete search history.

(56) References Cited

FOREIGN PATENT DOCUMENTS

| | | |
|---|---|---|
| JP | 06-286241 | 10/1994 |
| JP | 2000-254891 | 9/2000 |
| JP | 2000-263866 | 9/2000 |
| JP | 2001-277183 | 10/2001 |
| JP | 2002-137864 | 5/2002 |

OTHER PUBLICATIONS

Machine Translation of JP 2002-137864 A, May 14, 2002.*
Machine Translation of JP 2001-277183 A, Oct. 9, 2001.*

* cited by examiner

*Primary Examiner*—Judy Nguyen
*Assistant Examiner*—Jennifer Simmons
(74) *Attorney, Agent, or Firm*—Morgan, Lewis & Bockius LLP

(57) ABSTRACT

A half cut portion is provided with a receiving base for receiving a tube, and a cutter for cutting the tube. The receiving base is provided with a stroke adjusting lever on an upper portion of the receiving base, and the stroke adjusting lever is provided with a cam face in which an amount of projecting is varied by being rotated. The cutter butts to the cam face and a depth of a half cut is set according to a displacement of the amount of projecting of the cam face from the receiving base.

4 Claims, 16 Drawing Sheets

TAPE/TUBE PRINTER

TECHNICAL FIELD

The present invention relates to a tape/tube printer having a mechanism of printing a print medium of a tube, a tape or the like in an elongated shape and cutting a half of the print medium, particularly relates to a tape/tube printer capable of setting a half-cut depth in accordance with the print medium.

BACKGROUND ART

JP-A-06-286241 discloses a printer including a mechanism for printing a tape in an elongated shape contained in a cassette case for cutting a half of or fully cutting (full cut) the tape.

According to the half cut, only the print tape on a surface side of a tape in a seal-like shape pasted with exfoliating paper at a back face thereof is cut, thereby, the tape is made to be able to be transported in a state of connecting a number of the seals each constituted by a strip-like shape, and when the tape is used, the exfoliating paper is made to be able to be easily exfoliated.

Further, in a case of a printer of a certain kind according to a related art of the invention, printing can be carried out by removing a cassette case containing a tape and setting a tube in an elongated shape. According to the half cut of the tube, the tube is cut by leaving a portion thereof, the tube is made to be able to be transported in a state of connecting the tubes which are printed, and when used, the tube is made to be able to be cut easily without using scissors or the like. Further, the cut tube is attached to a cord of an electric wiring or the like to be used as a mechanism of identifying cords.

In a case of the printer capable of selectively setting to print the tape and the tube as print media according to the related art, when a half cut depth for carrying out half cut is made to stay the same for the tape and the tube, the half-cut depth is set for the tape having a thin thickness.

Therefore, there poses a problem that when half cut is carried out for the tube, since the half-cut depth is deep, the tube is unpreparedly cut when transporting the tube after subjecting the tube to half cut, and an effect of half cut cannot achieved.

Further, there poses a problem that since the half-cut depth is changed in accordance with the print medium, when a cutter is interchanged in accordance with the print medium, the cutter needs to be interchanged at each time of changing the print medium used to pose a problem that the operability is poor.

Further, when kinds of print media used are increased, also the cutters need to be prepared in accordance therewith to pose a problem of increasing costs.

DISCLOSURE OF THE INVENTION

One or more embodiments of the invention provide a tape/tube printer capable of easily setting a half-cut depth in accordance with a printed medium.

According to one or more embodiments of the invention, a tape/tube printer is provided with a carrying mechanism for feeding the elongated shape printed, a printing mechanism for printing the printed medium carried by the carrying mechanism and a cutting mechanism for cutting the printed medium. The cutting mechanism is provided with a receiving base for receiving a printed medium, a cutter including a blade portion moved in directions of being proximate to and remote from the receiving base for cutting the printed medium and a butt portion for forming a gap between the blade portion and the receiving base by being brought into contact with the receiving base, and an adjusting mechanism including a displacing face provided at a position of being brought into contact with the butt portion of the cutter for switching an amount of being projected from the receiving base.

According to one or more embodiments of the invention, the cutter is provided with the butt portions on both sides of in a direction of extending the blade portion, and the adjusting mechanism is provided with the displacing face at a position of being brought into contact with one of the butt portions of the cutter.

According to one or more embodiments of the invention, the adjusting mechanism is rotatably attached to the receiving base, and the displacing face is a cam face an amount of being projected from which is changed by being rotated.

According to one or more embodiments of the invention, the blade portion and the butt portion of the cutter are integrally constituted and rotatably supported.

According to one or more embodiments of the invention, when the printed medium is supported by the receiving base, and the cutter is moved to the position of bringing the butt portion into contact with the receiving base, by forming the gap between the blade portion of the cutter and the receiving base, the printed medium is cut by leaving a portion thereof. Further, an amount of the gap between the blade portion of the cutter and the receiving base is adjusted by displacing an amount of projecting a potion of being brought into contact with the butt portion of the cutter by the adjusting mechanism.

Thereby, the half-cut depth can be adjusted without interchanging the receiving base or the cutter, and can be set to an optimum half-cut depth in accordance with the printed medium used.

Other aspects and advantages of the invention will be apparent from the following description and the appended claims.

BRIEF DESCRIPTION OF THE DRAWINGS

FIG. 3 (*b*) is a perspective view showing the example of the constitution of the head moving mechanism, showing a state in which the thermal head is escaped from the platen roller.

FIG. 4 (*b*) is a perspective view showing the example of the constitution of the head moving mechanism, showing a state in which the thermal head is escaped from the platen roller.

FIG. 5 (*b*) is a perspective view of an essential portion showing the example of the constitution of the guide moving mechanism, showing a state in which the thermal head is escaped from the platen roller.

FIG. 8 (*b*) is a plane view of an essential portion showing the example of the constitution of the half cut portion, showing a state in which the half-cut depth is reduced.

FIG. 9 (*b*) is a perspective view showing a state of subjecting a tape to half cut.

FIG. 11 (*b*) is a side view showing the example of the constitution of the tube guide.

FIG. 13 (*b*) is a front view of an essential portion showing the operation of the discharge guide rib and the full cut portion, showing a state in which the thermal head is escaped from the platen roller.

FIG. 14 (*b*) is a side view showing the operation of the tube guide.

FIG. 15 (*b*) is a perspective view showing operation of the stroke adjusting lever, showing a state in which the half-cut depth is reduced.

FIG. 16 (*b*) is a side view showing the cutter in half cut, showing a state in which the half-cut depth is reduced.

DESCRIPTION OF REFERENCE NUMERALS AND SIGNS

Figure 1:
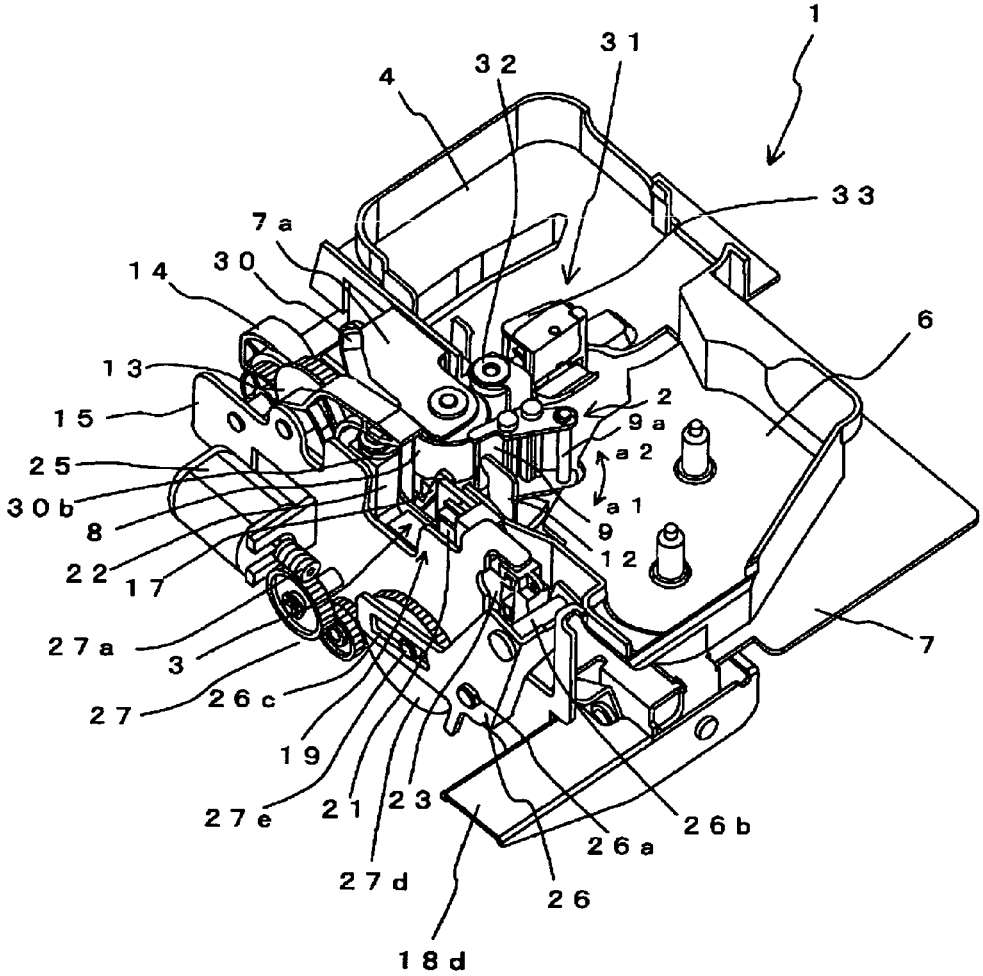
FIG. 1 is a perspective view showing an example of a total constitution of a tape/tube printer.

1 . . . tape/tube printer
2 . . . printing portion
3 . . . post processing portion
4 . . . cassette holder portion
4*a* . . . guide plate
7 . . . lower plate
8 . . . platen roller
9 . . . thermal head
11 . . . head moving mechanism
12 . . . head slider
13 . . . head moving lever
14 . . . head moving cam
16 . . . platen guide
17 . . . discharge guide rib
18 . . . full cut portion
19 . . . half cut portion
20 . . . guide bracket
21 . . . cutter
22 . . . receiving base
22*a* . . . butt face
25 . . . motor
27 . . . gear group
27*a* . . . worm gear
28 . . . blade portion
28*a* . . . leg portion
30 . . . stroke adjusting lever
30*b* . . . cam face
31 . . . tube guide mechanism
32 . . . guide roller
33 . . . tube guide
34 . . . tube pressing plate
34*a* . . . press portion
34*b* . . . spring portion

BEST MODE FOR CARRYING OUT THE INVENTION

One or more embodiments of the invention will be explained in reference to the drawings as follows.

Embodiments

Figure 2:
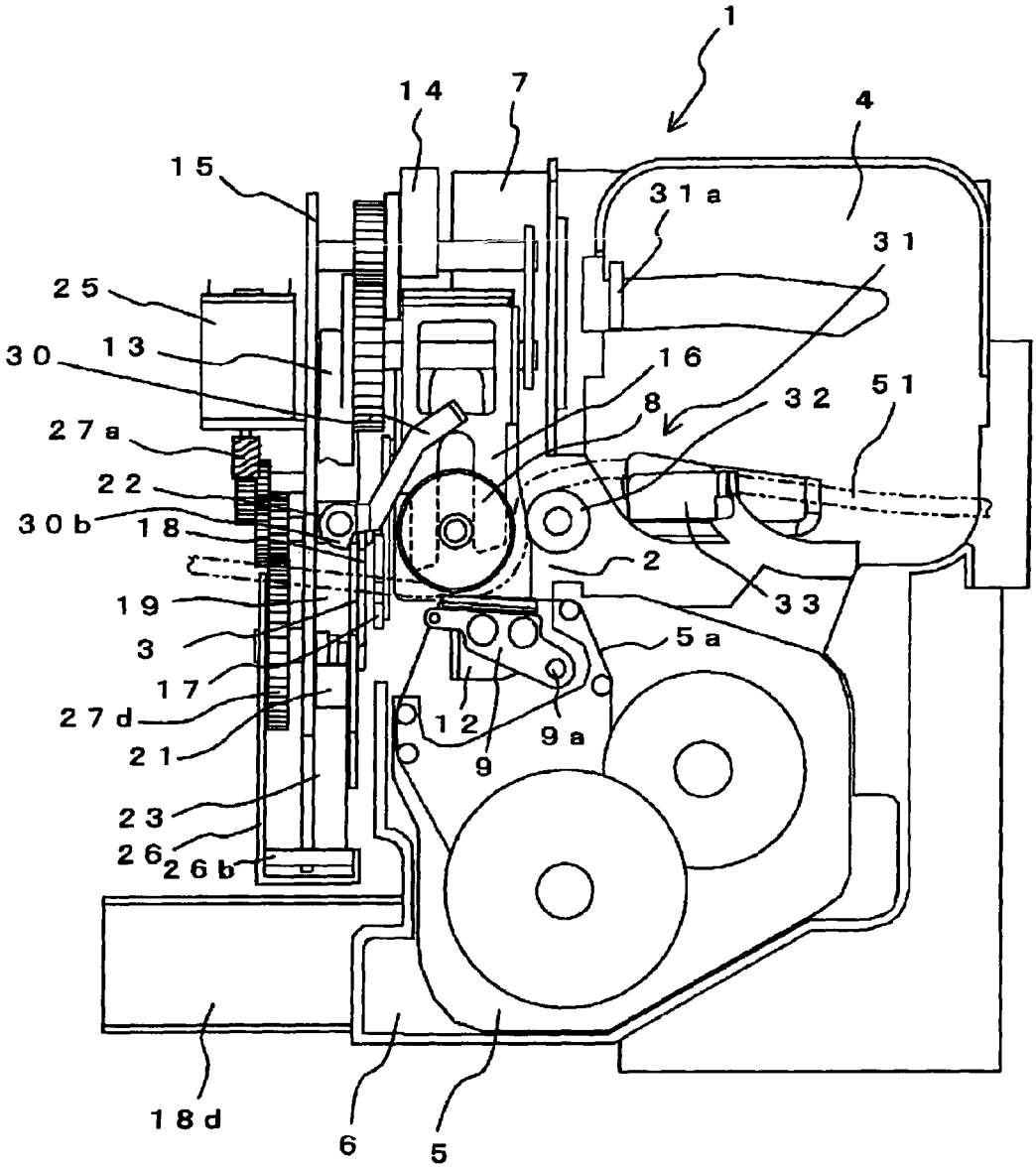
FIG. 2 is a plane view showing the example of the total constitution of the tape/tube printer.

FIG. 1 and FIG. 2 show a total constitution of a tape/tube printer 1 according to an embodiment, FIG. 1 is a perspective view, FIG. 2 is a plane view.

The tape/tube printer 1 prints a print medium in an elongated shape of a tape, a tube or the like set selectively. In the following example, an explanation will be given mainly centering on an example of printing a tube 51.

The tape/tube printer 1 includes the printing portion 2 and the post processing portion 3. The printing portion 2 includes a cassette holder portion 4 selectively set with a tape cassette, not illustrated, or the tube 51, and a ribbon holder portion 6 set with an ink ribbon cassette 5. The cassette holder portion 4 and the ribbon holder portion 6 are, for example, integrally molded products of a resin and attached to the lower plate 7.

Further, the printing portion 2 includes the platen roller 8 (carrying mechanism) and the thermal head 9 (printing mechanism). The platen roller 8 is supported by a bearing 7*a* attached to the lower plate 7 and the like and is rotated by being transmitted with a drive force of a motor, not illustrated.

Here, the drive force of the motor, not illustrated, for driving the platen roller 8 is transmitted also to a reel shaft for driving a reel for reeling an ink ribbon 5*a* of the ink ribbon cassette 5 and the platen roller 8 is rotated and the ink ribbon 5*a* is fed in synchronism with each other.

The thermal head 9 is arranged to be opposed to the platen roller 8. The thermal head 9 is supported by the lower plate 7 to be able to rotate by constituting a fulcrum by a shaft 9*a* and is moved in a direction of being proximate to the platen roller 8 by being operated to rotate in a direction of an arrow mark a1 by constituting the fulcrum by the shaft 9*a*. Thereby, the thermal head 9 pinches the ink ribbon 5*a* and a tape or a tube between the thermal head 9 and the platen roller 8 to bring about a printable state.

Further, the thermal head 9 is escaped by moving in a direction of being remote from the platen roller 8 by being operated to rotate in a direction of an arrow mark a2 constituting a fulcrum by the shaft 9*a*. Here, FIG. 1 and FIG. 2 show a state in which the thermal head 9 is disposed on the side of the platen roller 8.

Figure 3A:
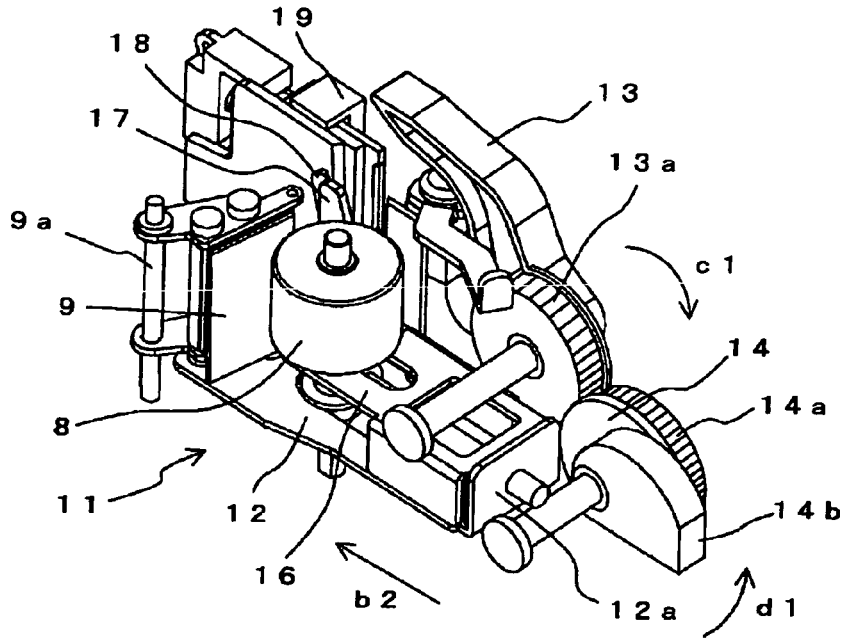
FIG. 3 (*a*) is a perspective view showing an example of a constitution of a head moving mechanism, showing a state in which a thermal head is disposed on a side of a platen roller.
Figure 3B:
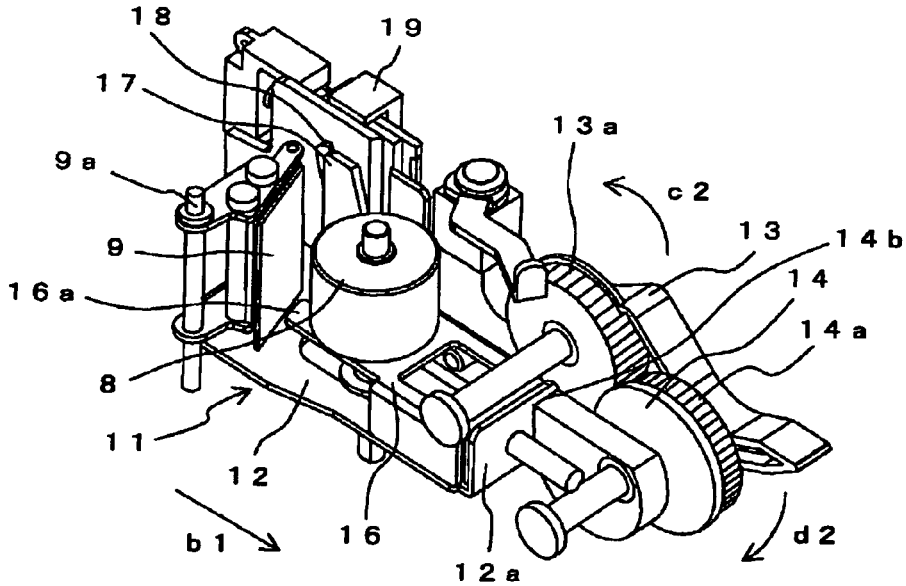

The printing portion 2 includes the head moving mechanism 11. FIG. 3 (*a*) through FIG. 4 (*b*) are perspective views showing an example of a constitution of the head moving mechanism 11, FIG. 3 (*a*), FIG. 4 (*a*) show a state in which the thermal head 9 is disposed on a side of the platen roller 8, FIG. 3 (*b*), FIG. 4 (*b*) show the state in which the thermal head 9 is escaped from the platen roller 8. Here, FIG. 3 (*a*) and FIG. 3 (*b*) illustrate the head moving mechanism 11 and the post processing portion 3, FIG. 4 (*a*) and FIG. 4 (*b*) illustrate mainly an essential portion of the head moving mechanism 11.

Figure 4A:
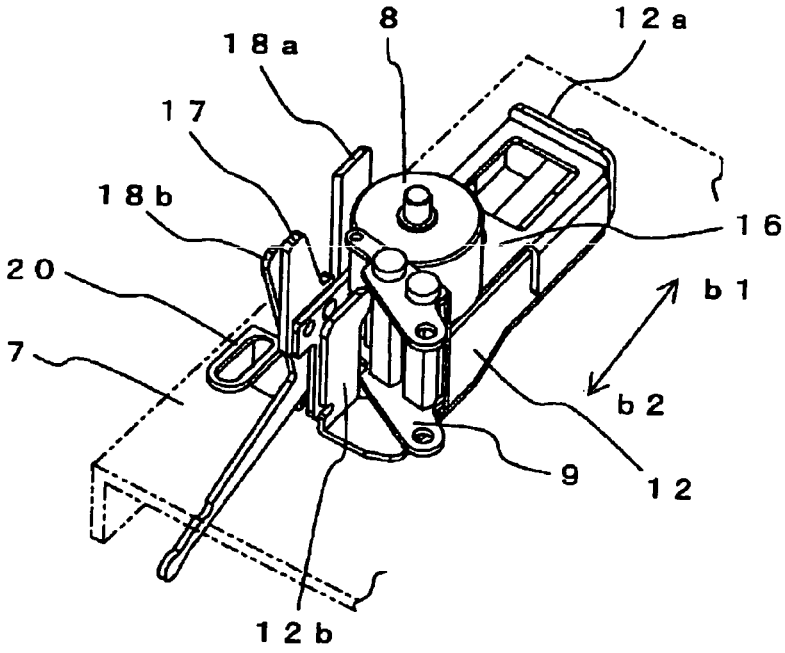
FIG. 4 (*a*) is a perspective view showing the example of the constitution of the head moving mechanism, showing a state in which the thermal head is disposed on the side of the platen roller.
Figure 4B:
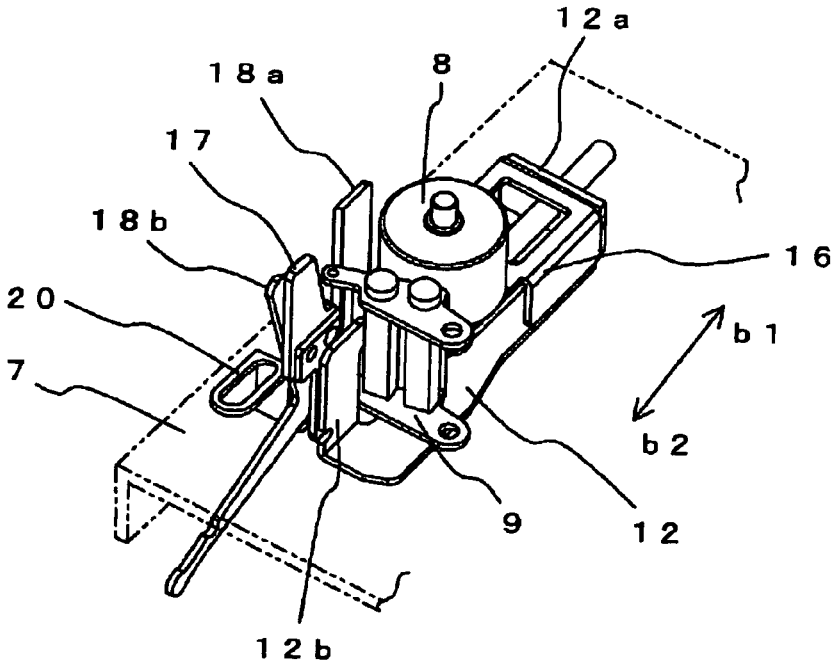

The head moving mechanism 11 includes the head slider 12, the head moving lever 13, and the head moving cam 14. As shown by FIG. 4 (*a*) and FIG. 4 (*b*), the head slider 12 is attached to the lower plate 7 to be able to slide to move, includes a cam press face 12*a* at one end portion thereof, and includes a head press portion 12*b* at other end thereof.

The head slider 12 includes a tension coil spring, not illustrated, between the head press portion 12*b* and the thermal head 9, by moving the head slider 12 in an arrow mark b1 direction, the head press portion 12*b* presses the thermal head 9 to press the thermal head 9 to the platen roller 8.

Further, by moving the head slider 12 in an arrow mark b2 direction, the head press portion 12*b* pulls the thermal head 9 by way of the spring, not illustrated, to escape the thermal head 9 from the platen roller 8.

The head moving lever 13 and the head moving cam 14 shown in FIG. 3 (*a*) and FIG. 3 (*b*) are rotatably supported by a shaft attached to a side plate 15 shown in FIG. 1 attached to an end portion of the lower plate 7. The head moving lever 13 includes a gear portion 13*a*, the head moving cam 14 includes a gear portion 14*a* brought in mesh with the gear portion 13*a*, and the head moving cam 14 is rotated by operating to rotate the head moving lever 13.

Further, the head moving cam 14 includes a cam face 14*b* a distance from a center of which is changed by operating to rotate the head moving cam 14. The cam face 14*b* of the head moving cam 14 is brought into contact with the cam press face 12*a* of the head slider 12, and when the cam face 14*b* of the head moving cam 14 is displaced by operating to rotate the head moving lever 13, the head slider 12 is slid to move. Thereby, the thermal head 9 is rotated by constituting the fulcrum by the shaft 9*a*.

The printing portion 2 includes the platen guide 16 (mount guide mechanism) for constituting a guide in setting the tube 51 or the like shown in FIG. 2 to the platen roller 8. Further, the post processing portion 3 arranged at a post stage of the printing portion 2 includes a discharge guide rib 17 (discharge guide mechanism), the full cut portion 18, the half cut portion 19 (cut mechanism). According to the example, the platen guide 16, the discharge guide rib 17 and the full cut portion 18 include a mechanism of moving in cooperation with the head slider 12.

Figure 5A:
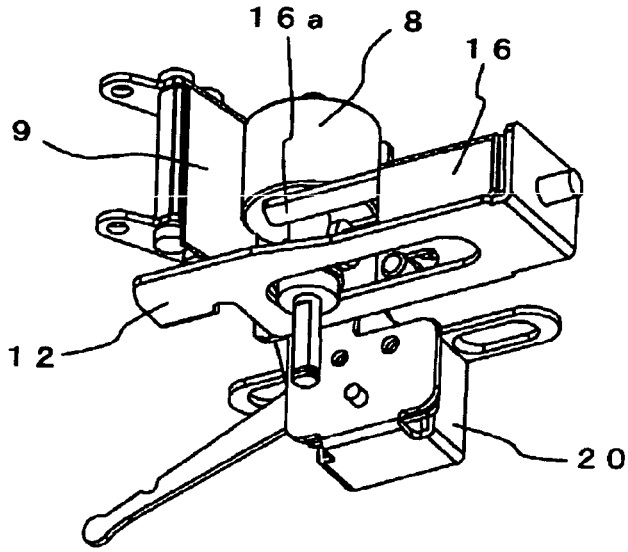
FIG. 5 (*a*) is a perspective view of an essential portion showing the example of the constitution of the guide moving mechanism, showing a state in which the thermal head is disposed on the side of the platen roller.
Figure 5B:
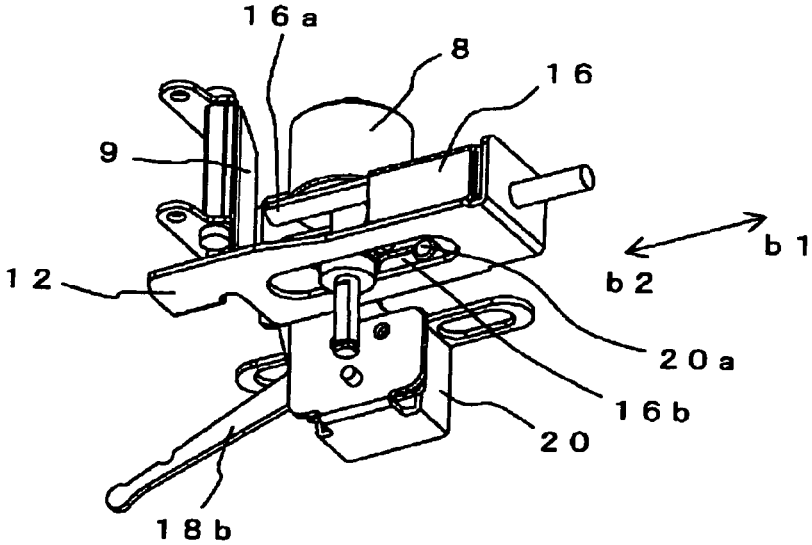

FIG. 5 (*a*) and FIG. 5 (*b*) are perspective views of an essential portion showing an example of a guide moving mechanism (moving mechanism), FIG. 5 (*a*) shows a state in which the thermal head 9 is disposed on the side of the platen roller 8, FIG. 5 (*b*) shows a state in which the thermal head 9 is escaped from the platen roller 8.

The platen guide 16 is slid to move integrally with the head slider 12, and is formed with a guide portion 16*a* at an end portion thereof. According to the example, in order to avoid the shaft of the platen roller 8, the guide portion 16*a* is arranged at a lower portion of the platen roller 8 by a shape divided in two.

According to the platen guide 16, the guide portion 16*a* is projected from a lower portion of the platen roller 8 as shown by FIG. 5 (*b*) by being moved in the arrow mark b2 direction of the head slider 12. Further, as shown by FIG. 5 (*a*), the guide portion 16*a* is escaped to the lower portion of the platen roller 8 by being moved in the arrow mark b1 direction of the head slider 12.

The discharge guide rib 17 is arranged at a post stage of the platen roller 8 and the thermal head 9. The discharge guide rib 17 includes a guide face 17*a* and is provided with a function of guiding such that the tube 51 or a tape cut by the full cut portion 18 is normally discharged in next printing.

Figure 6:
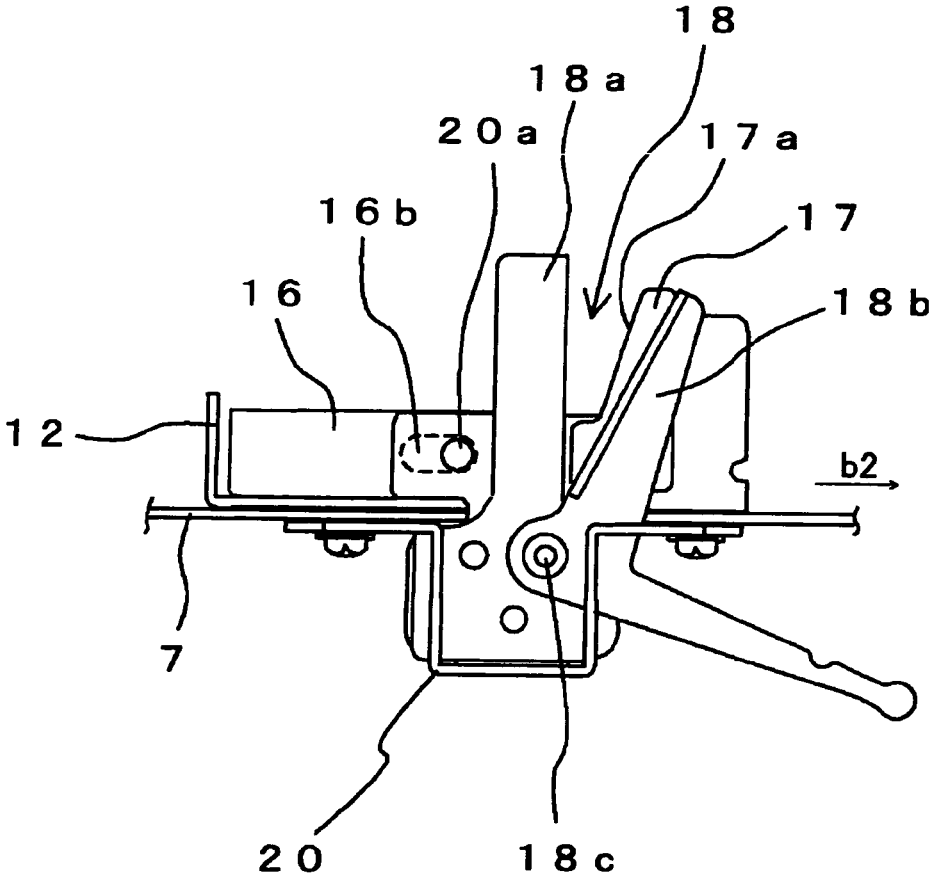
FIG. 6 is a front view of an essential portion showing an example of a constitution of a mechanism of moving a discharge guide rib.

FIG. 6 is a front view of an essential portion showing an example of a constitution of a mechanism of moving the discharge guide rib 17. The discharge guide rib 17 is attached to the guide bracket 20. The guide bracket 20 is movably attached to a lower face of the lower plate 7 in parallel with the head slider 12. The guide bracket 20 includes a boss 20*a* and the boss 20*a* is inserted to a long hole 16*b* formed at a side portion of the platen guide 16.

Thereby, by moving the platen guide 16 along with the head slider 12, also the guide bracket 20 is slid to move in the same direction, and the discharge guide rib 17 is moved in cooperation with the thermal head 9.

Therefore, in setting the tube or the tape, by escaping the discharge guide rib 17, the tube or the tape is easy to be set. Further, the guide face 17*a* is inclined to similarly facilitate to set the tube or the tape.

The full cut portion 18 is arranged at a post stage of the discharge guide rib 17. The full cut portion 18 includes a fixed blade 18*a* and a movable blade 18*b*. The fixed blade 18*a* is fixed to the guide bracket 20, the movable blade 18*b* is rotatably supported by a shaft 18*c* provided to the guide bracket 20, and by rotating the movable blade 18*b* by constituting a fulcrum by the shaft 18*c*, the tube or the tape is squeezed to be cut by the fixed blade 18*a* and the movable blade 18*b*. Further, the movable blade 18*b* is manually operated by cooperatively moving with operation of an operating lever 18*d* shown in FIG. 1 or the like.

Figure 7:
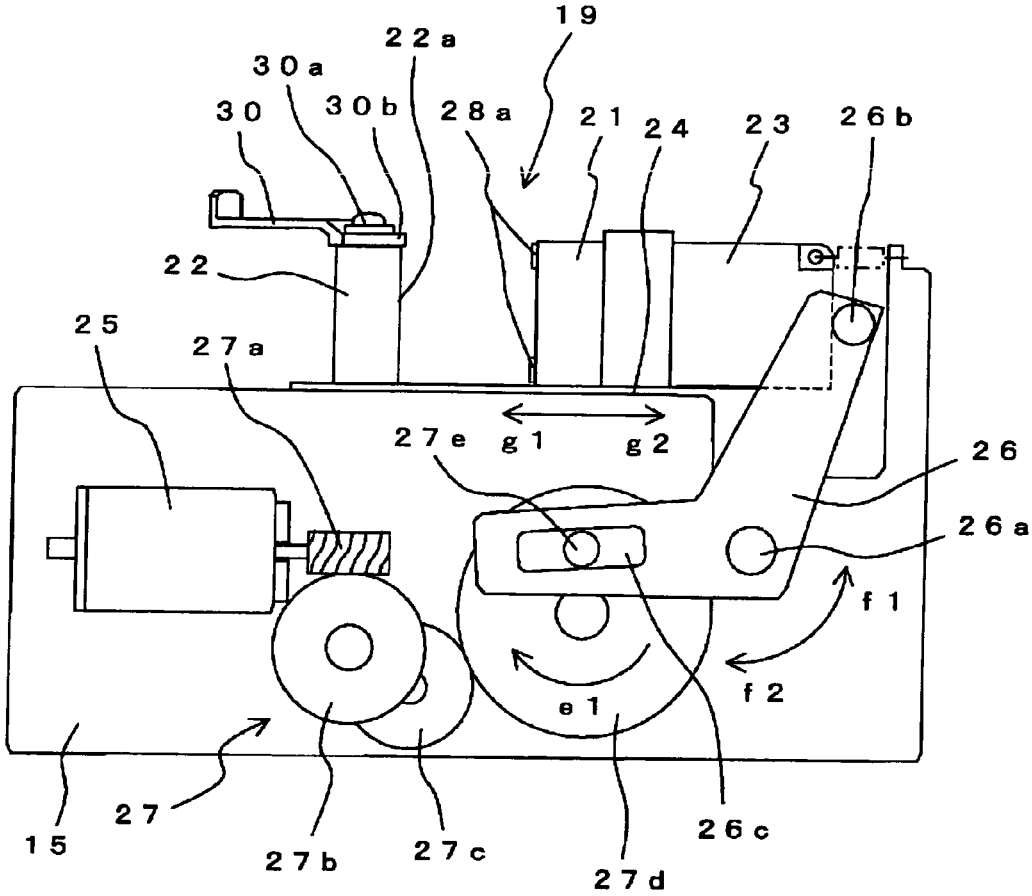
FIG. 7 is a front view showing an outline constitution of a half cut portion.
Figure 8A:
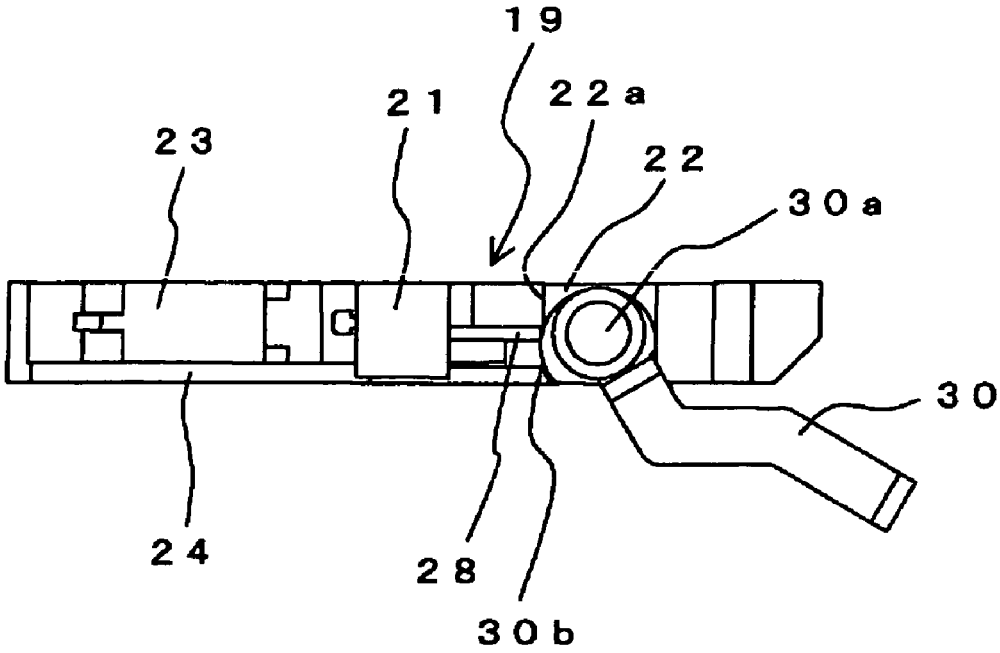
FIG. 8 (*a*) is a plane view of an essential portion showing an example of a constitution of the half cut portion, showing a state in which a half-cut depth is increased.
Figure 8B:
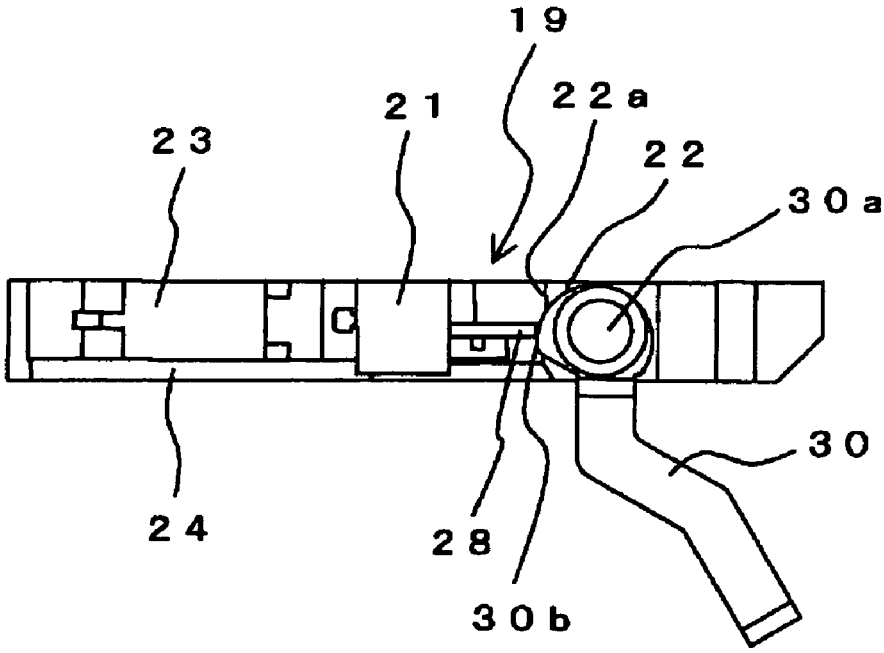

FIG. 7, FIG. 8 (*a*) and FIG. 8 (*b*) show an example of a constitution of the half cut portion 19, FIG. 7 is a front view showing an outline constitution of the half cut portion 19, and FIG. 8 (*a*) and FIG. 8 (*b*) are plane views of an essential portion thereof. The half cut portion 19 pinches the tube or the tape between the cutter 21 and the receiving base 22 to be subjected to half cut.

Figure 9A:
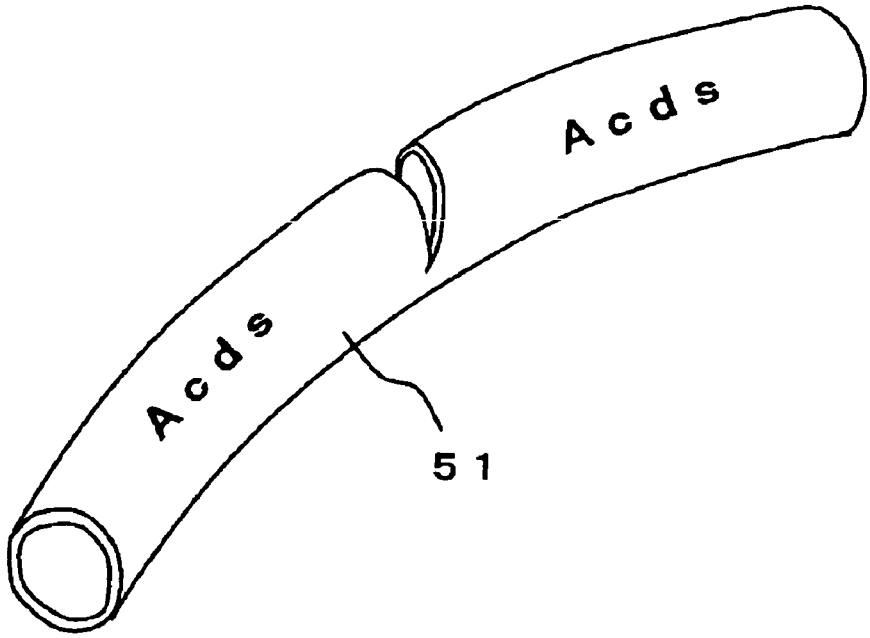
FIG. 9 (*a*) is a perspective view showing a state of subjecting a tube to half cut.
Figure 9B:
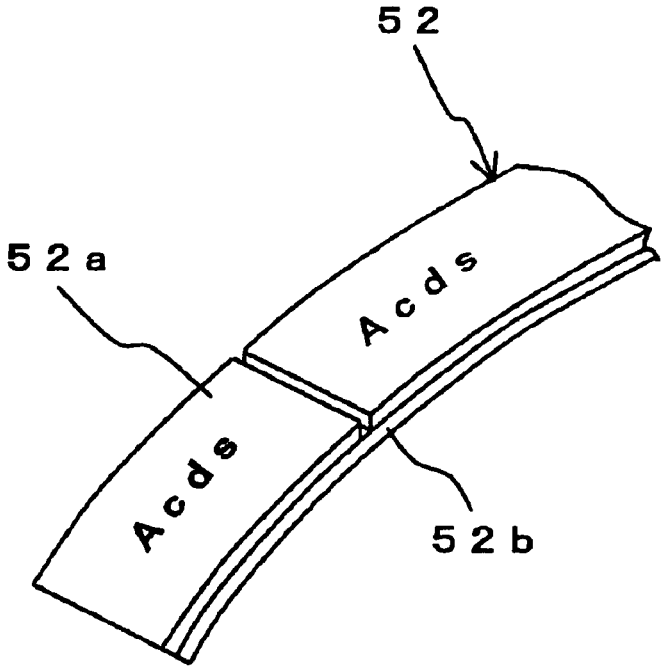

FIG. 9 (*a*) and FIG. 9 (*b*) are perspective views showing a state of subjecting the tube 51 and a tape 52 to half cut, FIG. 9 (*a*) shows a state of subjecting the tube 51 to half cut, FIG. 9 (*b*) shows a state of subjecting the tape 52 to half cut. When a processing object is the tube 51, half cut is a state of cutting the tube 51 except a portion in a circumferential direction. Thereby, the continuous tube 51 can easily be cut by exerting an external force thereto.

When the processing object is the tape 52, half cut is a state in which a print tape 52*a* on a surface side is cut, an exfoliating paper 52*b* on a back side is not cut. Thereby, by bending the tape 52, the print tape 52*a* can easily be exfoliated sheet by sheet.

Referring back to FIG. 7, FIG. 8 (*a*) and FIG. 8 (*b*), the cutter 21 is attached to a cutter holder 23. A holder guide 24 is formed at the lower plate 7 and the side plate 15, and the cutter holder 23 is made to be movable in a direction orthogonal to the tube or the tape.

The half cut portion 19 includes the motor 25 for driving the cutter holder, the cutter lever 26, and the gear group 27 for transmitting a drive force of the motor 25 to the cutter lever.

The cutter lever 26 is rotatably attached to the side plate 15 by constituting a fulcrum by a shaft 26*a*. One end of the cutter lever 26 includes a holder press portion 26*b* brought into contact with the cutter holder 23. Further, other end of the cutter lever 26 is formed with a long hole 26*c*.

The motor 25 is attached to the side plate 15 and the shaft is attached with the worm gear 27*a*. The worm gear 27*a* is brought in mesh with a first gear 27*b* constituting the gear group 27, the first gear 27*b* is brought in mesh with a second gear 27*c*, the second gear 27*c* is brought in mesh with a third gear 27*d*.

The third gear 27*d* includes a boss 27*e* at an eccentric position, the boss 27*e* is inserted into the long hole 26*c* of the cutter lever 26. Thereby, the drive force of the motor 25 is transmitted to the cutter lever 26 by way of the gear group 27, and the cutter lever 26 moves the cutter 21 attached to the cutter holder 23.

Here, by using the worm gear 27*a* for transmitting the drive force from the motor 25, the motor 25 can be attached in a direction orthogonal to the shafts of the gear group 27 and space saving formation can be achieved.

Figure 10:
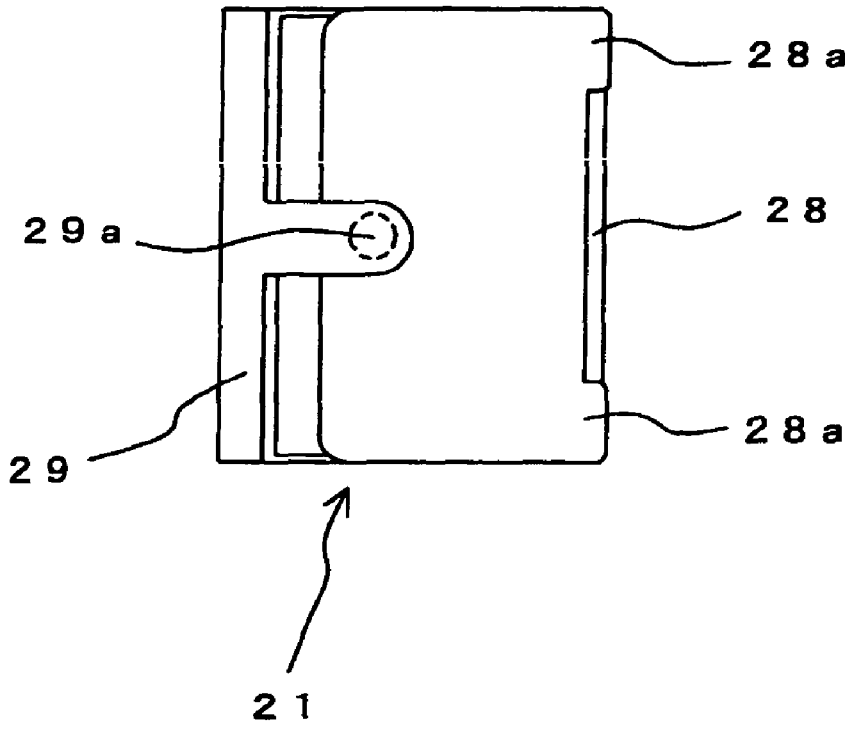
FIG. 10 is a side view showing an example of a constitution of a cutter.

FIG. 10 is a side view showing an example of a constitution of the cutter 21. The cutter 21 includes the blade portion 28 and the mount portion 29. The blade portion 28 is supported by the mount portion 29 in a rotatable state by constituting a fulcrum by a boss 29*a*. Further, the blade portion 28 is projected to be formed with the leg portions 28*a* (butt portions) at an upper and a lower portion thereof.

Referring back to FIG. 7, FIG. 8 (*a*) and FIG. 8 (*b*), the receiving base 22 includes the butt face 22*a* of the leg portion 28*a* shown in FIG. 10 of the cutter 21. Further, an upper portion of the receiving base 22 includes the stroke adjusting lever 30.

The stroke adjusting lever 30 is attached to an upper portion of the receiving base 22 rotatably by constituting a fulcrum by a shaft 30*a* and includes the cam face 30*b* displaced by being operated to rotate. The leg portion 28*a* on one side of the cutter 21 is brought into contact with the butt face 22*a* of the receiving base 22 and the leg portion 28*a* on other side is brought into contact with the cam face 30*b* of the stroke adjusting lever 30. Thereby, by displacing the cam face 30*b* by operating to rotate the stroke adjusting lever 30, a gap between the blade portion 28 of the cutter 21 and the receiving base 22 is adjusted.

Referring back to FIG. 1 and FIG. 2, the printing portion 2 includes the tube guide mechanism 31 at the cassette holder portion 4. The tube guide mechanism 31 includes the guide roller 32 for pressing the tube 51 to the platen roller 8, and the tube guide 33 (traveling guide mechanism) for guiding the tube 51 fed to the platen roller 8.

The guide roller 32 is arranged on an upstream side of the position of the platen roller 8 opposed to the thermal head 9. Thereby, the tube 51 in a tubular shape is deformed to a planer shape between the thermal head 9 and the platen roller 8 by increasing an angle thereof made to be wrapped on the platen roller 8 by squeezing the tube 51 between the guide roller 32 and the platen roller 8 and between the thermal head 9 and the platen roller 8.

Figure 11A:
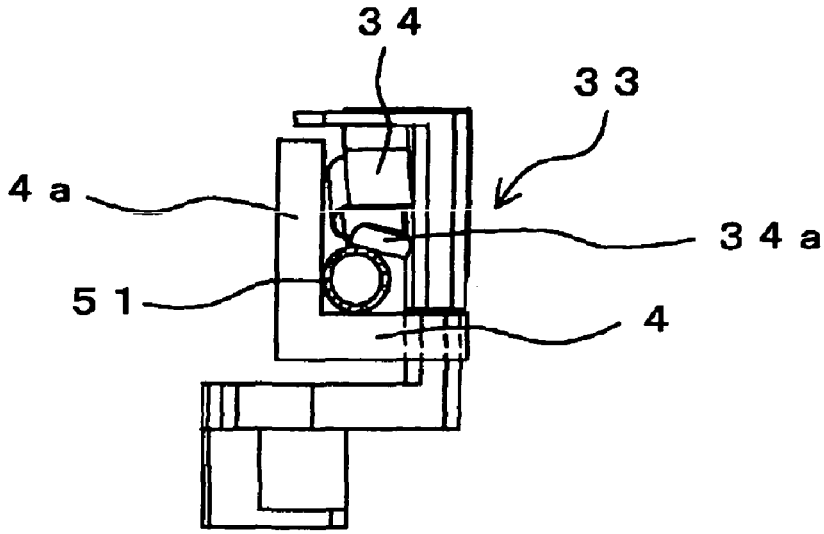
FIG. 11 (*a*) is a front view showing an example of a constitution of a tube guide.
Figure 11B:
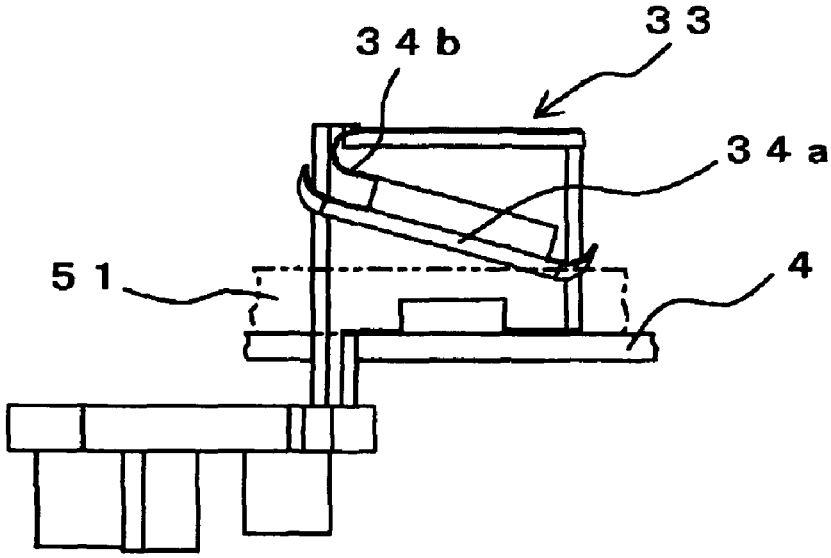

The tube guide 33 is arranged to be opposed to the guide plate 4*a* erected at the cassette holder portion 4. FIG. 11 (*a*) and FIG. 11 (*b*) show an example of a constitution of the tube guide 33, FIG. 11 (*a*) is a front view, FIG. 11 (*b*) is a side view.

The tube guide 33 includes the press portion 34*a* constituted by a spring member for deforming the tube 51 mainly in a direction of pressing the tube 51 to the guide plate 4*a* and the spring portion 34*b* for deforming the tube 51 mainly in a direction of pressing the tube 51 to a bottom face of the cassette holder portion 4 by way of the press portion 34*a*.

As shown by FIG. 11 (*a*), the press portion 34*a* is inclined to a vertical direction of the guide plate 4*a* and when the press portion 34*a* is deformed by pinching the tube 51 between the press portion 34*a* and the guide plate 4*a*, a force in a direction for pressing the tube 51 to the guide plate 4*a* and a force for pressing the tube 51 to the bottom face of the cassette holder 4 are produced.

Further, as shown by FIG. 11 (*b*), the press portion 34*a* is inclined to the bottom face of the cassette holder portion 4 by the spring portion 34*b*, when the spring portion 34*b* is deformed by squeezing the tube 51 between the press portion 34*a* and the guide plate 4*a*, a force for pressing the tube 51 mainly to the bottom face of the cassette holder 4 by way of the press portion 34*a* is produced.

Further, according to the tape/tube printer 1, the tube 51 having a different diameter can be used, according to the tube guide mechanism 31, by inclining the press portion 34*a* to the bottom face of the cassette holder 4, a difference of the diameter of the tube 51 is absorbed by deforming the spring portion 34*b*.

<Operation of Tape/Tube Printer>

Figure 12:
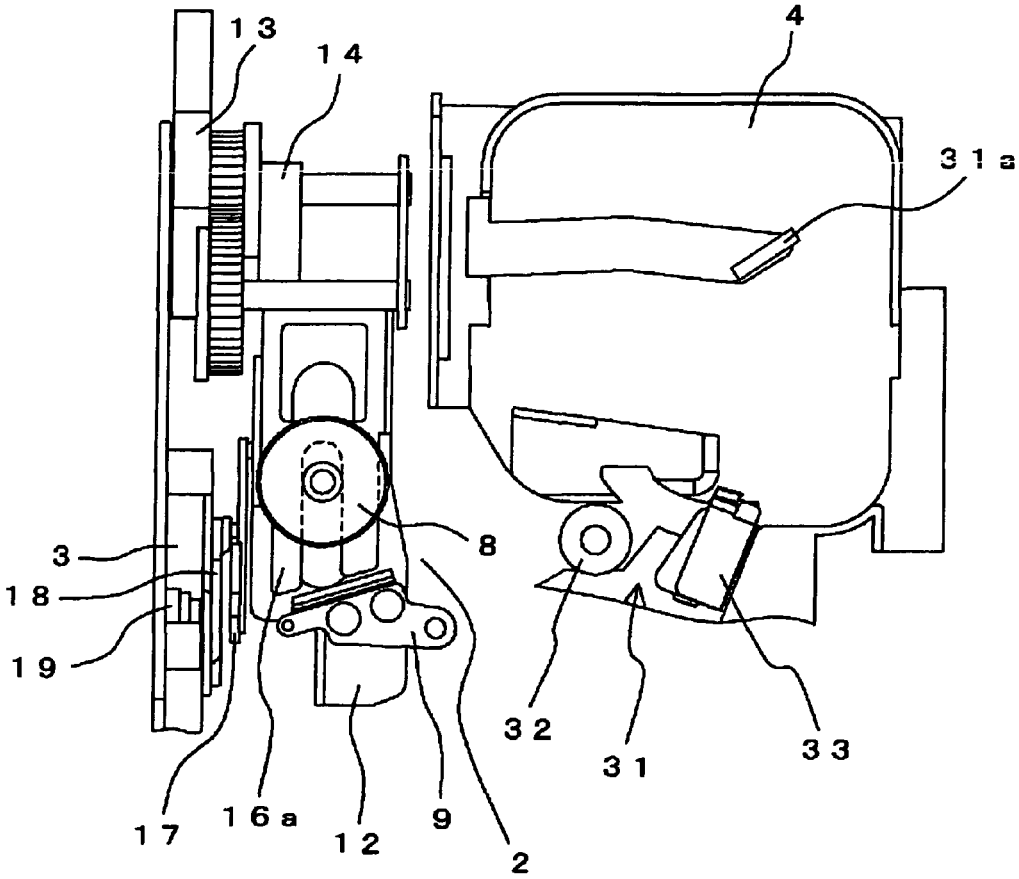
FIG. 12 is a plane view of an essential portion of a tape/tube printer showing a state before mounting a tube.

Next, operation of the tape/tube printer 1 according to the embodiment will be explained. FIG. 12 is a plane view of an essential portion of the tape/tube printer 1 showing a state before mounting the tube, first, an explanation will be given of operation of setting the tube to the tape/tube printer 1. In order to set the tube 51 to the tape/tube printer 1, in a state in which the cassette holder portion 4 is not mounted with a tape cassette, not illustrated, by operating an escape lever 31*a*, the guide roller 32 and the tube guide 33 is escaped to a position shown in FIG. 12.

When the guide roller 32 is escaped, a space is formed between the guide roller 32 and the platen roller 8. Further, when the tube guide 33 is escaped, a space is formed between the tube guide 33 and the guide plate 4*a*.

Here, when the guide roller 32 and the tube guide 33 are escaped, the escape lever 31*a* is disposed at a vicinity of a middle of the cassette holder portion 4 to thereby enable to prevent the tape cassette from being erroneously mounted thereto.

Further, by operating the head moving lever 13, as shown by FIG. 3 (*b*), FIG. 4 (*b*) and FIG. 5 (*b*), the thermal head 9 is escaped from the platen roller 8. In order to escape the thermal head 9, the head moving lever 13 is rotated in an arrow mark c1 direction from a state shown in FIG. 3 (*a*). When the head moving lever 13 is rotated in the arrow mark c1 direction, the head moving cam 14 is rotated in an arrow mark d1 direction by bringing the gear 13*a* and the gear 14*a* of the head moving cam 14 in mesh with each other.

Thereby, the cam face 14*b* of the head moving cam 14 is brought into contact with the cam press face 12*a* of the head slider 12. By further rotating the head moving lever 13 in the arrow mark c1 direction from the state, the head slider 12 is pressed by the press face 12*a* of the head moving cam 14 to move the head slider 12 in the arrow mark b2 direction.

When the head slider 12 is moved in the arrow mark b2 direction, the head press portion 12*b* pulls the thermal head 9 by way of the spring, not illustrated, as shown by FIG. 1, the thermal head 9 is rotated in the arrow mark a2 direction by constituting the fulcrum by the shaft 9*a*, as shown by FIG. 3 (*b*), FIG. 4 (*b*) and FIG. 5 (*b*), the thermal head 9 is escaped from the platen roller 8.

Now, by operating to escape the thermal head 9, the platen guide 16 is moved in the arrow mark b2 direction in cooperation with the head slider 12. Thereby, when the thermal head 9 is escaped, as shown by FIG. 5 (*b*) or the like, the guide portion 16*a* of the platen guide 16 is projected from a peripheral face of the platen roller 8 at a lower portion of the platen roller 8.

Further, when the platen guide 16 is moved in the arrow mark b2 direction, the discharge guide rib 17 and the full cut portion 18 are moved in the arrow mark b2 direction in cooperation therewith.

That is, as shown by FIG. 6, since the guide bracket 20 attached with the discharge guide rib 17 and the full cut portion 18 is inserted into the long hole 16*b* of the platen guide 16, by moving the platen guide 16 in cooperation with the head slider 12, the boss 20*a* is pressed by the long hole 16*b*, and also the guide bracket 20 is moved in the arrow mark b2 direction.

Figure 13A:
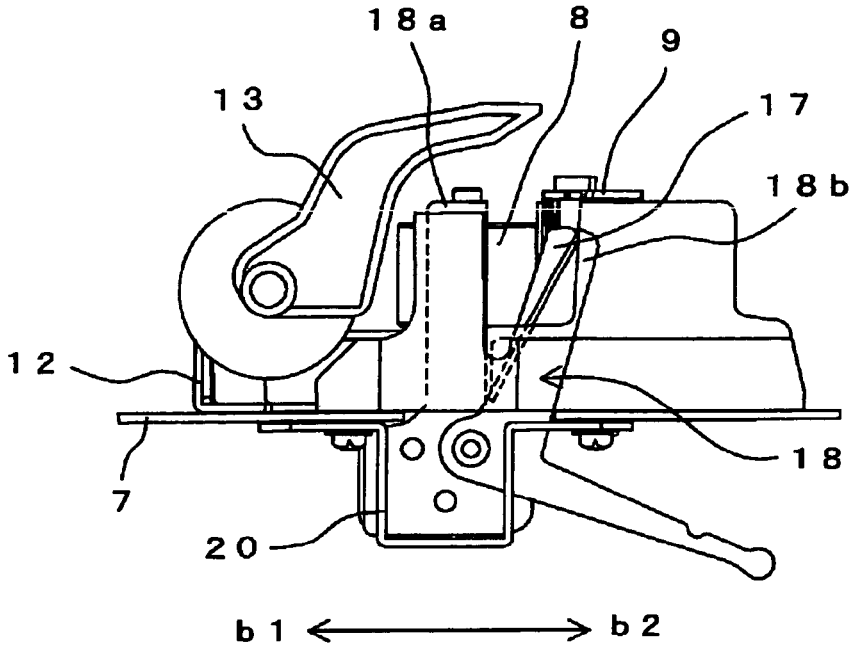
FIG. 13 (*a*) is a front view of an essential portion showing operation of a discharge guide rib and a full cut portion, showing a state in which a thermal head is disposed on a side of a platen roller.
Figure 13B:
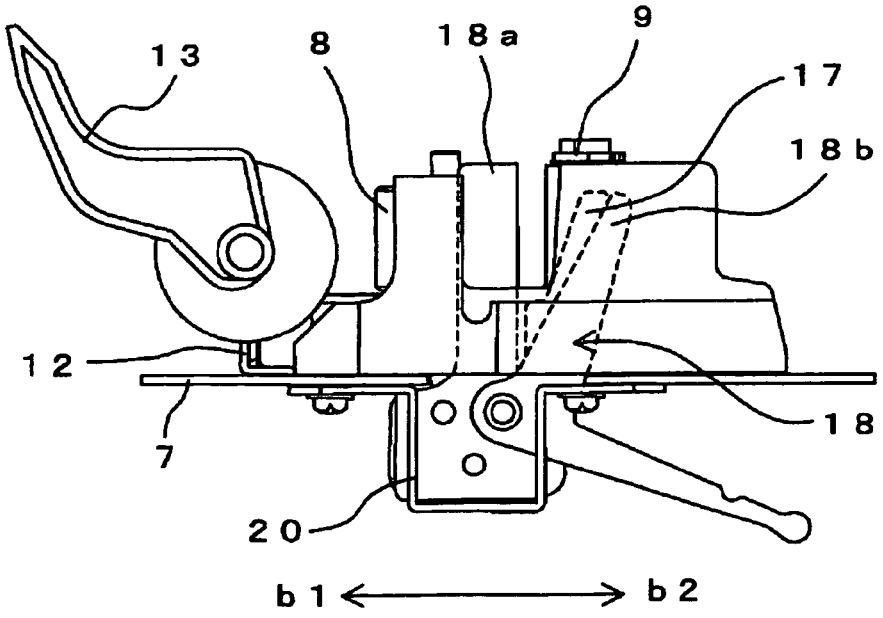

FIG. 13 (*a*) and FIG. 13 (*b*) are front views of an essential portion showing operation of the discharge guide rib 17 and the full cut portion 18, FIG. 13 (*a*) shows a state in which the thermal head 9 is disposed on the side of the platen roller 8, FIG. 13 (*b*) shows a state in which the thermal head 9 is escaped from the platen roller 8.

By moving the head slider 12 in the arrow mark b2 direction, as shown by FIG. 13 (*b*), when the thermal head 9 is escaped from the platen roller 8, by moving also the discharge guide rib 17 and the full cut portion 18 in the arrow mark b2 direction in cooperation therewith, the discharge guide rib 17 is escaped from a traveling path of the tube 51.

By the above-described operation, as shown by FIG. 12, an interval between the tube guide 33 and the guide plate 4*a*, an interval between the guide roller 32 and the platen roller 8 and an interval between the thermal head 9 and the platen roller 8 constituting the traveling path of the tube 51 are opened to bring about a state of enabling to set the tube 51.

The tube 51 is set by a path shown in FIG. 2. In setting the tube 51, as described above, since the guide portion 16*a* of the platen guide 16 is projected to the lower side of the platen roller 8, the tube 51 is prevented from being brought to the lower side of the platen roller 8.

Further, since the discharge guide rib 17 is escaped from the traveling path of the tube 51, in setting the tube 51, the tube can be passed to a wide space, and setting is facilitated.

Next, by operating the escaping lever 31*a*, the guide roller 32 and the tube guide 33 are moved to set positions shown in FIG. 2. When the guide roller 32 is moved to the set position, the tube 51 is squeezed between the guide roller 32 and the platen roller 8.

Further, when the tube guide 33 is moved to the set position, the tube 51 is pinched between the tube guide 33 and the guide plate 4*a*. When the tube 51 is pinched between the tube guide 33 and the guide plate 4*a*, as shown by FIG. 11 (*a*) and FIG. 11 (*b*), since the press portion 34*a* of the tube press plate 34 is inclined to the vertical direction of the guide plate 4*a*, the tube 51 is pressed to the guide plate 4*a* and pressed to the bottom face of the cassette holder portion 4 by the press portion 34*a*.

Figure 14A:
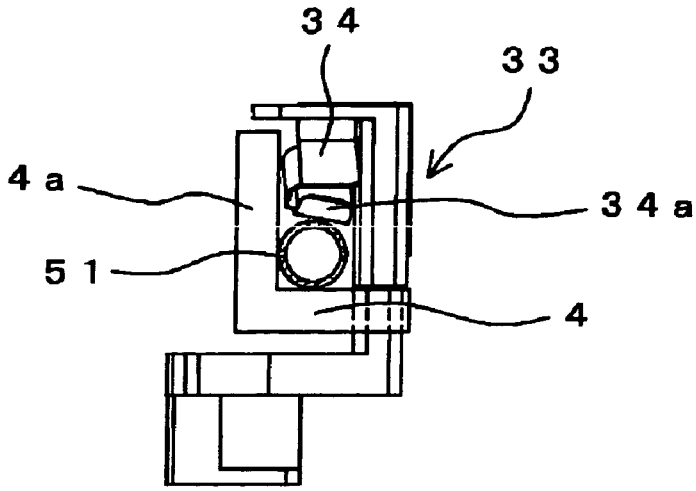
FIG. 14 (*a*) is a front view showing operation of a tube guide.
Figure 14B:
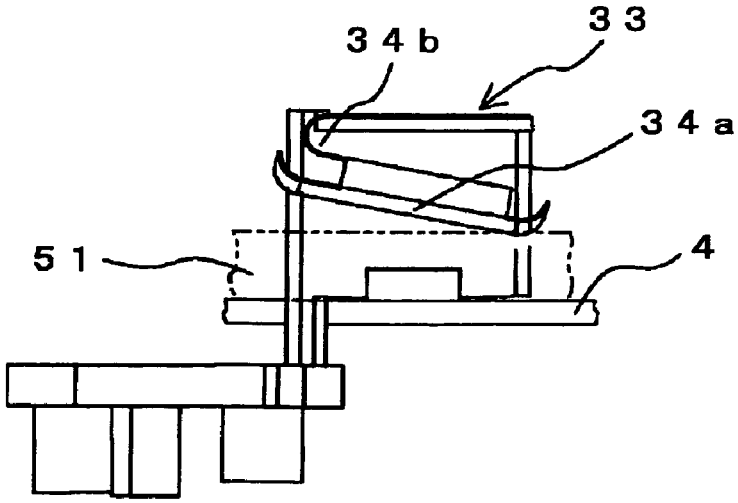

FIG. 14 (*a*) and FIG. 14 (*b*) show operation of the tube guide 33, FIG. 14 (*a*) is a front view, FIG. 14 (*b*) is a side view. Here, FIG. 11 (*a*) and FIG. 11 (*b*) show a state of setting the tube 51 having a slender diameter, FIG. 14 (*a*) and FIG. 14 (*b*) show a state of setting the tube 51 having a bold diameter.

The tape/tube printer 1 can use the tube 51 having a diameter of from about 2.5 mm to about 5.5 mm. Therefore, as shown by FIG. 11 (*a*) and FIG. 11 (*b*), a plate thickness of the tube press plate 34, a shape, an angle of inclination and the like of the press portion 34*a* are set such that the press portion 34*a* can press the tube 51 by a predetermined force even when the tube 51 having the slender diameter is set.

Further, when the tube 51 having the bold diameter is set as shown by FIG. 14 (*a*) and FIG. 14 (*b*), the angle of inclination of the press portion 34*a* relative to the vertical direction of the guide plate 4*a* and the angle of inclination relative to the bottom face of the cassette holder portion 4 are further reduced, and amounts of deforming the press portion 34*a* and the spring 34*b* are increased.

In this way, by inclining the press portion 34*a* to the bottom face of the cassette holder portion 4 by the spring portion 34*b*, an amount of deforming the press portion 34*a* in the up and down direction can be increased, and the tube 51 having a different diameter can be dealt with. Further, the plate thickness of the tube press plate 34, the shape, the angle of inclination or the like of the press portion 34*a* are set such that the press force does not become excessively large even by the tube 51 having the bold diameter.

Further, since the press portion 34*a* is inclined to the vertical direction of the guide plate 4*a*, the tube 51 can be pressed to the guide plate 4*a* and can be held in a state of being pressed to the bottom face of the cassette holder portion 4 regardless of the diameter of the tube 51, and according to the tube guide mechanism 31, the tube 51 can be positioned in both of an up and down direction and a left and right direction relative to the traveling direction of the tube 51.

Next, in order to pinch the tube 51 between the thermal head 9 and the platen roller 8, the head moving lever 13 is rotated in an arrow mark c2 direction from the state shown in FIG. 3 (*b*). When the head moving lever 13 is rotated in the arrow mark c2 direction, the head moving cam 14 is rotated in an arrow mark d2 direction by bringing the gear 13*a* and the gear 14*a* of the head moving cam 14 in mesh with each other.

The cam face 14*b* of the head moving cam 14 is constituted by a shape by which the amount of projecting from center is gradually reduced when rotated in the arrow mark d2 direction from the state shown in FIG. 3 (*b*) and therefore, the head slider 12 is moved in the arrow mark b1 direction by being pressed by a spring, not illustrated, by rotating the head moving cam 14 in the arrow mark d2 direction.

When the head slider 12 is moved in the arrow mark b1 direction, as shown by FIG. 4 (*a*), the head press portion 12*b* presses the thermal head 9, as shown by FIG. 1, the thermal head 9 is rotated in the arrow mark a1 direction by constituting the fulcrum by the shaft 9*a*, as shown by FIG. 3 (*a*), FIG. 4 (*a*) and FIG. 5 (*a*), the thermal head 9 is made to be proximate to the platen roller 8, as shown by FIG. 2, the tube 51 is pinched thereby.

Now, in operation of pinching the tube 51 between the thermal head 9 and the platen roller 8 by the thermal head 9, the platen guide 16 is moved in the arrow mark b1 direction in cooperation with the head slider 12. Thereby, when the guide portion 16*a* is moved by moving the thermal head 9 and the tube 51 is pinched between the thermal head 9 and the platen roller 8 by the thermal head 9, as shown by FIG. 2 or the like, the guide portion 16*a* of the platen guide 16 is escaped from the peripheral face of the platen roller 8.

Thereby, the thermal head 9 and the guide portion 16*a* are not brought into contact with each other. Further, when the thermal head 9 is moved, the guide portion 16*a* is present on the lower side of the platen roller 8. Therefore, in the operation of pinching the tube 51 between the thermal head 9 and the platen roller 51 by the thermal head 9, a state of being unable to be printed by clogging the tube or the like is prevented from being brought about by bringing the tube 51 to the lower side of the platen roller 8.

Further, when the platen guide 16 is moved in the arrow mark b1 direction, as shown by FIG. 13 (*a*), the discharge guide rib 17 and the full cut portion 18 are moved in the arrow mark b1 direction in cooperation therewith, and the discharge guide rib 17 is projected to a portion of the traveling path of the tube 51.

By the above-described operation, as shown by FIG. 2, the tube 51 is squeezed between the tube guide 33 and the guide plate 4*a* (not illustrated in FIG. 2) in the tube guide mechanism 31, as shown by FIG. 11 (*a*) and FIG. 11 (*b*) or the like, the tube 51 is held in a state of being positioned in both of the up and down direction and left and right direction relative to the traveling direction.

Further, as shown by FIG. 2, by pinching the tube 51 between the guide roller 32 and the platen roller 8 and between the thermal head 9 and the platen roller 8, the tube 51 is made to be wrapped on the platen roller 8 in the traveling path on the upstream side of the thermal head 9. Thereby, by increasing the angle of the tube 51 made to be wrapped on the platen roller 8, a sufficient carrying force is transmitted to the tube 51, and the tube 51 in the tubular shape is deformed to the planer shape between the thermal head 9 and the platen roller 8.

Next, printing operation will be explained. Further, since the printing operation by the thermal head 9 and the platen roller 8 is well known, a detailed explanation thereof will be omitted, the tube 51 is printed by the thermal head 9 while feeding the tube 51 by driving to rotate the platen roller 8 by the motor, not illustrated.

As described above, the tube 51 is held in a state of being positioned in both of the up and down direction and left and right direction relative to the traveling direction by the tube guide 33 in the tube guide mechanism 31.

Thereby, when the tube 51 is fed for printing, the movement of the tube 51 in the up and down direction before being fed to the platen roller can be restrained and a positional shift for printing can be restrained from being brought about.

The tube 5 subjected to the printing is discharged from between the thermal head 9 and the platen roller 8 to the post processing portion 3 and is subjected to half cut by the half cut portion 19 as necessary.

Next, the half cut operation will be explained. First, explaining flow of a total operation in half cut, when the motor 25 is started to be driven to rotate at a predetermined timing, as shown by FIG. 7, the third gear 27*d* is rotated in an arrow mark e1 direction by rotating the motor 25, the boss 27*e* provided to the third gear 27*d* is moved at inside of the long hole 26*c* of the cutter lever 26 to rotate the cutter lever 26 in an arrow mark f1 direction by constituting the fulcrum by the shaft 26*a*.

When the cutter lever 26 is rotated in the arrow mark f1 direction, the holder press portion 26*b* is brought into contact with the cutter holder 23 to press the cutter holder 23. Thereby, the cutter holder 23 is moved in an arrow mark g1 direction along with the cutter 21 by being guided by the holder guide 24.

When the cutter 21 is moved to a position of butting the receiving base 22, the cutter lever 26 is rotated in an arrow mark f2 direction of a reverse direction by rotating the third gear 27*d* in the arrow mark e1 direction from a positional relationship between the long hole 26*c* and the boss 27*e*. Thereby, the cutter holder 23 is moved in an arrow mark g2 direction by a force of a spring, not illustrated, and the cutter 21 is separated from the receiving base 22.

Further, when it is detected that the cutter lever 26 returns to a home position by a sensor or the like, not illustrated, the motor 25 is stopped to be driven. By the above-described, the tube 51 is subjected to half cut.

Next, details of the half cut operation will be explained. The tape/tube printer 1 of the example can print both of the tube 51 shown in FIG. 9 (*a*) and the tape 52 shown in FIG. 9 (*b*). Further, even the tube 51 having the different diameter can be printed, further, the stroke adjusting lever 30 is provided as an adjusting mechanism for carrying out half cut accurately regardless of a kind of the object of printing.

Figure 15A:
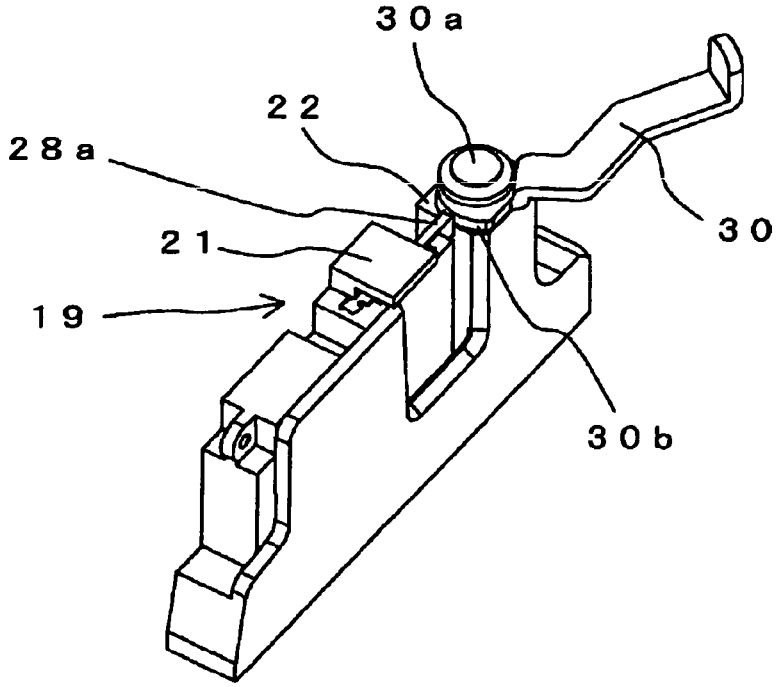
FIG. 15 (*a*) is a perspective view showing operation of a stroke adjusting lever, showing a state in which a half-cut depth is increased.
Figure 15B:
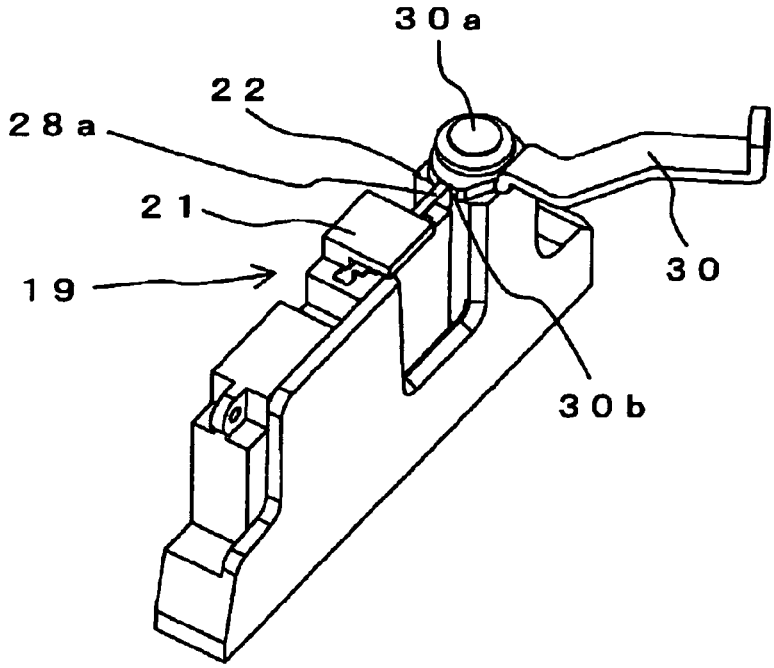

FIG. 15 (*a*) and FIG. 15 (*b*) are perspective views showing operation of the stroke adjusting lever 30, FIG. 15 (*a*) and FIG. 8 (*a*) mentioned above show a state of increasing the half-cut depth, FIG. 15 (*b*) and FIG. 8 (*b*) show a state of reducing the half-cut depth.

The stroke adjusting lever 30 includes the cam face 30*b* displaced by being operated to rotate by constituting the fulcrum by the shaft 30*a*. The cam face 30*b* is constituted by a shape of gradually changing the distance from the shaft 30*a* constituting the center by operating to rotate the stroke adjusting lever 30. Thereby, an amount of projecting the cam face 30*b* from the receiving base 22 is adjusted by rotating the stroke adjusting lever 30.

Figure 16A:
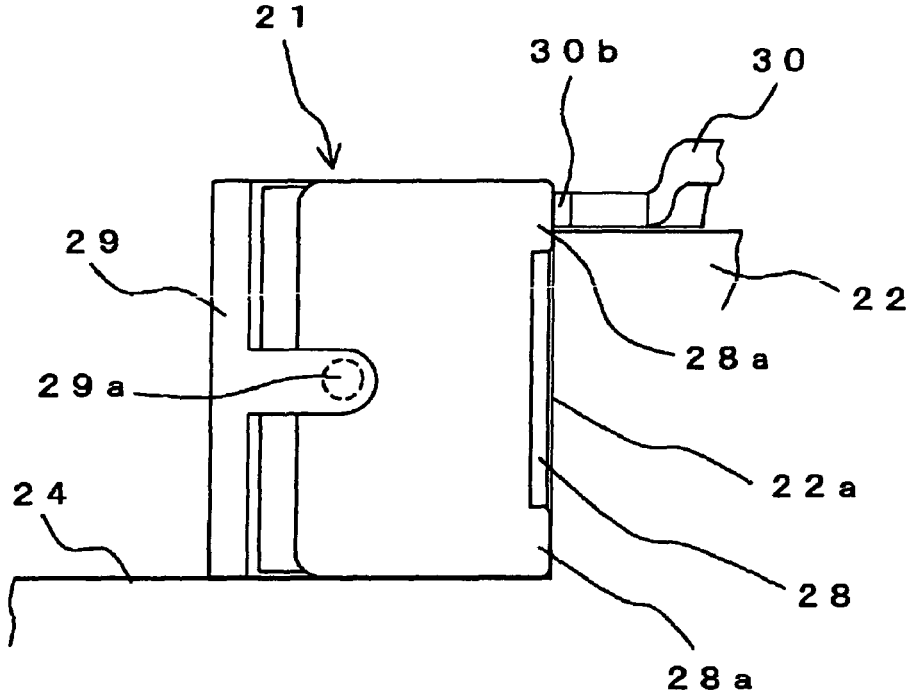
FIG. 16 (*a*) is a side view showing a state of a cutter in half cut, showing a state in which a half-cut depth is increased.
Figure 16B:
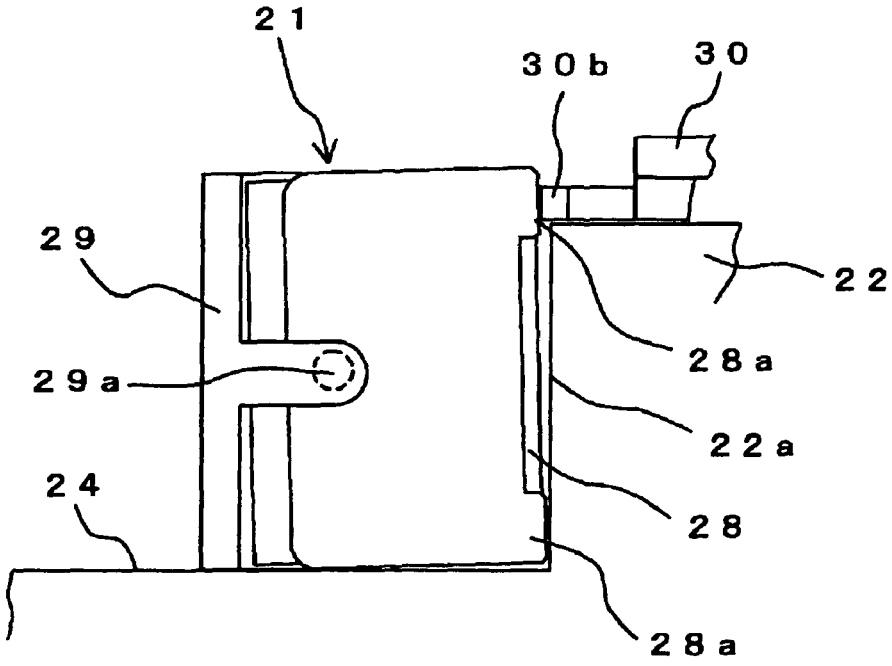

When the direction shown by FIG. 8 (*a*), FIG. 15 (*a*) is constituted by rotating the stroke adjusting lever 30, the amount of the cam face 30*b* projected from the butt face 22*a* of the receiving base 22 is minimized. FIG. 16 illustrates side views showing states of the cutter 21 in half cut, FIG. 16 (*a*) shows a state of increasing the half-cut depth by reducing the amount of projecting the cam face 30*b*, FIG. 16 (*b*) shows a state of reducing the half-cut depth by increasing the amount of projecting the cam face 30*b*.

When the half cut operation is carried out by constituting a direction of the stroke adjusting lever 30 by the direction shown in FIG. 8 (*a*), FIG. 15 (*a*), as shown by FIG. 16 (*a*), the leg portion 28*a* on the lower side of the cutter 21 is brought into contact with the receiving base 22 and the upper side leg portion 28*a* is brought into contact with the butt face 22*a* of the receiving base 22.

According to the example, it is set that the cam face 30*b* and the butt face 22*a* become substantially the same face when the amount of projecting the cam face 30*b* from the receiving base 22 is minimized. Thereby, the blade portion 28 of the cutter 21 becomes substantially in parallel with the face of the receiving base 22 and the half-cut depth is increased.

In contrast thereto, when a direction shown in FIG. 8 (*b*), FIG. 15 (*b*) is constituted by rotating the stroke adjusting lever 30, the amount of projecting the cam face 30*b* from the receiving base 22 is maximized. When the half cut operation is carried out by constituting the direction of the stroke adjusting lever 30 by the direction shown in FIG. 8 (*b*), FIG. 15 (*b*), as shown by FIG. 16 (*b*), the lower side leg portion 28*a* of the cutter 21 is brought into contact with the butt face 22*a* of the receiving base 22, and the upper side leg portion 28*a* is brought into contact with the cam face 30*b* of the stroke adjusting lever 30 projected from the butt face 22*a*.

The cutter 21 is supported by the mounted portion 29 in a state in which the blade portion 28 is rotatable by constituting the fulcrum by the boss 29*a*. Thereby, when the cutter 21 is pressed to the receiving base 22 by operating the cutter lever 26 shown in FIG. 7 or the like, the blade portion 28 is rotated by constituting the fulcrum by the boss 29*a* in accordance with the amount of projecting the cam face 30*b*, and the blade portion 28 is brought into a state of being inclined to the butt face 22*a* of the receiving base 22. Therefore, in comparison with FIG. 16 (*a*), the gap between the blade portion 28 of the cutter 21 and the receiving base 22 is increased and the half-cut depth is reduced.

When the tape 52 shown in FIG. 9 (*b*) is subjected to half cut, the tape 52 is cut by leaving the exfoliating paper 52*b* and therefore, the half-cut depth is set to be large as shown by FIG. 16 (*a*). In contrast thereto, in a case of subjecting the tube 51 shown in FIG. 9 (*a*) to half cut, when a half-cut depth the same as that of the tape 52 is set, the cut amount is excessively large, and there is a case in which the tube 51 subjected to half cut is unpreparedly cut in transporting the tube 51.

Therefore, by setting the half-cut depth to be small as shown by FIG. 16 (*b*), the half cut can be carried out to a state in which the tube 51 is not cut unpreparedly in transporting the tube 51 and can easily be cut as necessary.

In this way, the half-cut depth can be adjusted by operating the stroke adjusting lever 30 and therefore, it is not necessary to interchange the receiving base 22 and the cutter 21 in accordance with the processing object and operability is promoted. Further, the stroke adjusting lever 30 can arbitrarily adjust the half-cut depth and therefore, the stroke adjusting lever 30 can easily deal with even the tube 51 having a different diameter.

The tube 51 subjected to printing and subjected to half cut as necessary is stopped to be fed by stopping to drive the thermal head 9 and drive to rotate the platen roller 8 when predetermined printing is finished. Further, the tube 51 is cut by the full cut portion 18.

By operating the operating lever 18*d* shown in FIG. 1 or the like, the full cut portion 18 pinches the tube 51 to cut by the fixed blade 18*a* and the movable blade 18*b* by rotating the movable blade 18*b* by constituting the fulcrum by the shaft 18*c*.

When the tube 51 is fully cut by the full cut portion 18, since the tube 51 is provided with an elasticity, a front end of the unprinted tube 51 is going to return to a side opposed to the winding direction of the platen roller 8.

Therefore, unless the discharge guide rib 17 is provided, by feeding the tube 51 in printing at a successive time, the front end of the tube 51 is brought into contact with the half cut portion 19 or the like to be unable to be fed to bring about clogging of the tube and failure in printing.

In contrast thereto, by providing the discharge guide rib 17 as shown by FIG. 13 (*a*), the front end of the tube 51 is guided in the winding direction of the platen roller 8, and the tube 51 can be prevented from being brought into contact with the half cut portion 19 or the like in printing at a successive time.

Further, as described above, the discharge guide rib 17 is escaped as shown by FIG. 13 (*b*) in setting the tube 51 or the like and therefore, operation of setting the tube 51 in a narrow space is dispensed with and operability in setting is promoted.

Although the invention has been explained in details and in reference to specific embodiments, it is apparent for the skilled person that the invention can variously be changed and modified without deviating from the spirit and the range of the invention.

The application is based on Japanese Patent Application (Japanese Patent Application No. 2004-213583) files on Jul. 21, 2004, and contents of which are incorporated herein by reference.

INDUSTRIAL APPLICABILITY

The invention is applied to a printer capable of selecting a tape or a tube in an elongated shape and can particularly restrain a failure in half cut from being brought about in printing the tube.

The invention claimed is:

1. A tape/tube printer comprising:

a receiving base for receiving a printed medium;

a cutter which is movable in directions of being proximate to and remote from the receiving base and includes a blade portion for cutting the printed medium and a butt portion; and a cam face rotatable around a shaft fixed on the receiving base, the cam face having a shape of gradually changing a distance between the cam face and the shaft so that a projection amount of the cam face from the receiving base is adjusted by rotating the cam face, wherein the butt portion is brought into contact with the cam face to form a gap between the blade portion and the receiving base, and an amount of the gap between the blade portion and the receiving base is adjusted in accordance with the projection amount of the cam face from the receiving base.

2. The tape/tube printer according to claim 1, further comprising:

a carrying mechanism for feeding the printed medium; and a printing mechanism for printing the printed medium fed by the carrying mechanism.

3. The tape/tube printer according to claim 1, wherein the cutter is provided with leg portions on both sides of the cutter in a direction of extending the blade portion; and one of the leg portions acts as said butt portion which is brought into contact with the cam face.

4. The tape/tube printer according to claim 1, wherein the blade portion and the butt portion of the cutter are integrally constituted and rotatably supported around a boss on a mounted portion.

* * * * *